US007083206B1

(12) United States Patent
Johnson

(10) Patent No.: US 7,083,206 B1
(45) Date of Patent: Aug. 1, 2006

(54) DOUBLEDEADLOCK™: A TRUE COMBINATION DOOR LATCH AND DEADBOLT LOCK WITH OPTIONAL AUTOMATIC DEADBOLT LOCKING WHEN A DOOR IS LATCHED

(75) Inventor: Richard C. Johnson, Poquott, NY (US)

(73) Assignee: Industrial Widget Works Company, Poquott, NY (US)

( * ) Notice: Subject to any disclaimer, the term of this patent is extended or adjusted under 35 U.S.C. 154(b) by 0 days.

(21) Appl. No.: 11/246,783

(22) Filed: Oct. 7, 2005

(51) Int. Cl.
*E05B 63/20* (2006.01)

(52) U.S. Cl. ..... 292/332; 70/107

(58) Field of Classification Search ..... 292/DIG. 21, 292/332, 333, 334, 335; 70/107
See application file for complete search history.

(56) References Cited

U.S. PATENT DOCUMENTS 2,254,702 A * 9/1941 Karavia ..... 70/486
4,561,684 A 12/1985 Marotto
4,671,549 A 6/1987 Marotto et al.
4,712,396 A 12/1987 Cary et al.
5,044,182 A 9/1991 Totten
5,058,938 A * 10/1991 Doring et al. ..... 292/45
5,094,488 A 3/1992 Boadwine et al.
5,657,653 A 8/1997 Hensley et al.
5,927,769 A * 7/1999 Pullen ..... 292/169.13
5,941,581 A 8/1999 Heithe
6,196,035 B1 * 3/2001 Tsui ..... 70/107
6,422,614 B1 7/2002 Kuntz et al.
6,449,995 B1 9/2002 Paolini et al.

* cited by examiner

*Primary Examiner*—Gary Estremsky
(74) *Attorney, Agent, or Firm*—Young Law Firm, P.C.

(57) ABSTRACT

A combined automatic latch and deadbolt assembly includes a latch configured to selectively assume a retracted and extended configuration and a deadbolt configured to selectively assume a cocked and a released configuration. The combined automatic latch and deadbolt assembly may be configured such that causing the latch to transition from its retracted configuration to its extended configuration causes the deadbolt to transition from its cocked configuration to its extended configuration.

20 Claims, 2 Drawing Sheets

DOUBLEDEADLOCK™: A TRUE COMBINATION DOOR LATCH AND DEADBOLT LOCK WITH OPTIONAL AUTOMATIC DEADBOLT LOCKING WHEN A DOOR IS LATCHED

BACKGROUND OF THE INVENTION

1. Field of the Invention

Embodiments of the present invention relates to door latching and locking mechanisms. More particularly, embodiments of the present invention relate to combination door latch and deadbolt assemblies such as (but not limited to) locks on doors providing access to residential dwellings and commercial spaces.

2. Description of the Related Art

Conventional locks having deadbolts require the user to manually lock the deadbolt. Because of this, users often forget to set the deadbolt, thereby exposing the home or apartment to entry, as even a locked door latch may be easily defeated by burglars or other undesirables. Also, people leaving their home carrying a child or packages may be more likely to leave the deadbolt in the unlocked position rather than putting the child or packages down in order to manually set the deadbolt.

Conventional door locks without added deadbolts suffer from a number of disadvantages. For example, a conventional door lock may be readily defeated by a skilled person equipped with no more than a credit card. Although far more secure, deadbolts conventionally require the user to use his or her key to lock the door on leaving the house. Previous attempts to combine latches and deadbolts, allowing the deadbolt to be set as the door closes, have not enjoyed great commercial success, mainly due to their high complexity, low reliability and high cost.

What are needed, therefore, are new assemblies and methods for locking and deadbolting doors. More particularly, what are needed are assemblies and methods that enable a door to be locked and deadbolted simply by closing the door. Preferably, such assemblies and methods should offer such functionality while enjoying a simple, elegant and inexpensive construction.

SUMMARY OF THE INVENTION

According to an embodiment thereof, the present invention is a combined automatic latch and deadbolt assembly that may include a latch; a deadbolt configured to selectively assume a cocked and a released configuration, the deadbolt defining a deadbolt feature; a wheel mounted for rotation, the wheel being coupled to the latch and defining a plurality of wheel gear teeth; a deadbolt pin defining a first and a second end, the deadbolt pin defining deadbolt pin gear teeth near the first end, the second end being configured to selectively engage with and disengage from the deadbolt feature, and the wheel and the deadbolt pin being configured such that movement of the latch causes the wheel to rotate and the wheel gear teeth to engage the deadbolt pin gear teeth so as to selectively a) engage the second end of the deadbolt pin with the deadbolt feature to cause the deadbolt to assume the cocked configuration, and b) disengage the second end of the deadbolt pin from the deadbolt feature to cause the deadbolt to assume the released configuration.

The combined automatic latch and deadbolt assembly may further include a first resilient member that is configured to elastically couple the deadbolt pin to a support. The first resilient member may include a first spring. The combined automatic latch and deadbolt assembly may further include a second resilient member that is configured to elastically couple the deadbolt to a support. The second resilient member may include a second spring. The deadbolt feature may include a blind bore defined within the deadbolt, and the blind bore may be configured to receive the second end of the deadbolt pin. According to another embodiment, two rotations of the wheel may return the combined automatic latch and deadbolt assembly to a same state of operation. The combined automatic latch and deadbolt assembly may further include a connecting rod coupled to the latch and to the wheel. The connecting rod may be coupled near the circumference of the wheel, for example.

According to another embodiment thereof, the present combined automatic latch and deadbolt assembly includes a latch configured to selectively assume a retracted and extended configuration and a deadbolt configured to selectively assume a cocked and a released configuration. In this embodiment, the combined automatic latch and deadbolt assembly may be configured such that causing the latch to transition from its retracted configuration to its extended configuration causes the deadbolt to transition from its cocked configuration to its extended configuration.

The latch and the deadbolt may be spring loaded. The combined automatic latch and deadbolt assembly may further include a mechanical coupling configured to couple the latch to the deadbolt. The deadbolt may include a deadbolt feature and the mechanical coupling may include a deadbolt pin configured to selectively engage the deadbolt feature when the deadbolt is in its cocked configuration and to disengage from the deadbolt feature to cause the deadbolt to transition from its cocked configuration to its released configuration. The deadbolt pin may define a first and a second end. The deadbolt pin may define deadbolt pin gear teeth near the first end and the second end may be configured to selectively engage with and disengage from the deadbolt feature. The combined automatic latch and deadbolt assembly may further include a wheel mounted for rotation, the wheel being coupled to the latch and defining a plurality of wheel gear teeth, the wheel and the deadbolt pin being further configured such that movement of the latch causes the wheel to rotate and the wheel gear teeth to engage the deadbolt pin gear teeth so as to selectively a) engage the second end of the deadbolt pin with the deadbolt feature to cause the deadbolt to assume the cocked configuration, and b) disengage the second end of the deadbolt pin from the deadbolt feature to cause the deadbolt to assume the released configuration.

A first resilient member may be configured to elastically couple the deadbolt pin to a support. The first resilient member may include a first spring. The combined automatic latch and deadbolt assembly may further include a second resilient member that is configured to elastically couple the deadbolt to a support. The second resilient member may include a second spring. The deadbolt feature may include a blind bore defined within the deadbolt and the blind bore may be configured to receive the deadbolt pin. According to one embodiment, two rotations of the wheel may return the combined automatic latch and deadbolt assembly to the same state of operation. The combined automatic latch and deadbolt assembly may further include a connecting rod coupled to the latch and to the wheel. The connecting rod is coupled near a circumference of the wheel, for example.

DESCRIPTION OF THE PREFERRED EMBODIMENTS

According to embodiments of the present invention, a door may be automatically latched and deadbolted (i.e., locked, with the deadbolt set and fully engaged) merely by shutting the door with the latch set to lock. According to an embodiment thereof, the present invention is a mechanical device that is configured to combine the conventional functions of the two major types of door locks; namely a conventional lock that can automatically close through the action of its latch and be securely locked with the deadbolt as the door is closed without having to separately actuate a dead bolt lock that requires that a key be used from the outside each time the door is secured.

Figure 1:
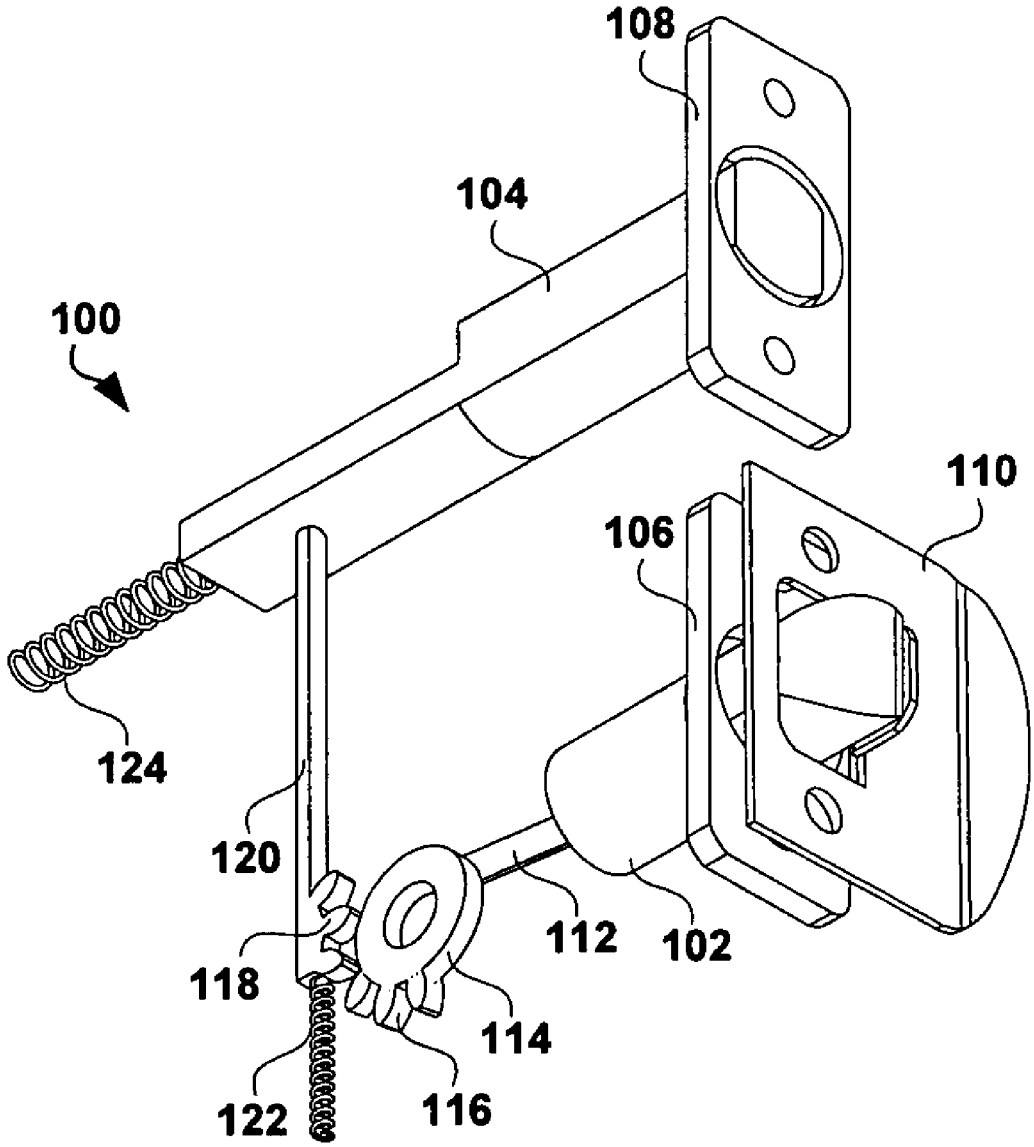
FIG. 1 is a view of the combined automatic latch and deadbolt assembly, according to an embodiment of the present invention.

FIG. 1 is a view of the combined automatic latch and deadbolt assembly, with the latch and the deadbolt in respective first positions, according to an embodiment of the present invention. In this view, the deadbolt has been recocked and the latch is not yet opened, as would be required to open the door. As shown therein, the combined automatic latch and deadbolt assembly 100 may include a latch 102 having a first and a second end. The first end of the latch 102 may be configured to extend within an opening defined within a latch plate 106 and within an aligned opening defined within a latch striker plate 110. The latch striker plate 110 may be mounted to a door frame (not shown). The present combination automatic latch and deadbolt assembly 100 may also include a wheel 114 that may include a number of gear teeth 116. The wheel 114 may be coupled to the latch 102 by a connecting rod 112 such that motion of the latch 102 pushes and pulls on the connecting rod 112 so as to cause the wheel 114 to rotate about its center. Note that, according to an embodiment of the present invention, the wheel 114 is equipped with gear teeth 116 over only a portion of its circumference, although other embodiments may be envisaged in which the wheel 114 is equipped with gear teeth 116 over its entire circumference. A dead bolt pin, shown at reference numeral 120 in FIG. 1, may include a number of deadbolt pin gear teeth 118. The deadbolt pin 120 may have the same number, a greater number or a lesser number of gear teeth 118 as the number of gear teeth 116 of the wheel 114. In the embodiment shown in FIG. 1, the deadbolt pin 120 has the same number of gear teeth 118 as the number of gear teeth 116 on the wheel 114. The deadbolt pin 120 and the wheel 114 may be mutually disposed such that the deadbolt pin gear teeth 118 may engage the gear teeth 116 of the wheel 114. The wheel gear teeth 116 and the deadbolt pin gear teeth may alternatively be configured as cogs or most any other functionally equivalent interlocking structural feature, as those of skill in this art may recognize. The deadbolt pin 120 may be resiliently coupled to a stationary support (not shown) by means of a first resilient member 122 such as, for example, a first spring. The deadbolt pin 120 may be configured to move along its longitudinal axis over a predetermined distance under the action of the first resilient member 122 and/or the turning gear teeth 116 of the wheel 114. The deadbolt pin 120 may extend and engage within an appropriately sized blind bore defined within a deadbolt 104. The blind bore defined within the deadbolt 104 is best shown at reference numeral 105 in FIGS. 2–5. The motion of the deadbolt pin 120 may be constrained by fitting it within a cylindrical opening only slightly larger in diameter than the diameter of the deadbolt pin 120.

The deadbolt 104 may also define a first end and a second end. The first end of the deadbolt 104 may be configured to extend within an opening defined within a deadbolt plate 108. The deadbolt plate 108 may be mounted to the door (not shown in FIGS. 2–5) or may be mounted on the door frame. The second end of the deadbolt 104, opposite the first end, may be resiliently coupled to a stationary support (not shown) by a second resilient member 124 such as, for example, a second spring. The automatic latch and deadbolt assembly 100 in FIG. 1 appears as it would just after the deadbolt 104 is retracted and just before the latch 102 is withdrawn to open the door. In this view, the gear teeth 116 of the wheel 114 are positioned just past the mating deadbolt pin gear teeth 118, having allowed the deadbolt pin 120 to be pushed up by the first resilient member 122 into the blind bore defined in the deadbolt 104. This effectively cocks the deadbolt 104. Note that the automatic latch and deadbolt assembly 100, according to an embodiment of the present invention, may require two revolutions of the wheel (one for each completed withdrawal and extension of the latch 102) to again pull the deadbolt pin 120 from its blind bore 105.

Figure 2:
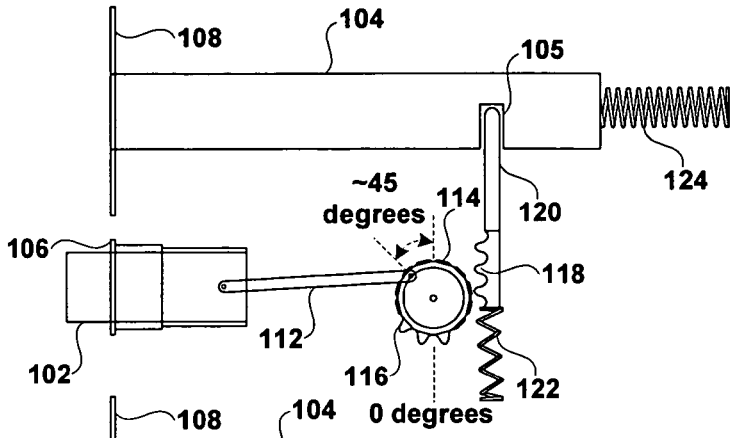
FIG. 2 is a side view of the combined automatic latch and deadbolt assembly in a configuration in which the door (not shown) is closed but the deadbolt is cocked, according to an embodiment of the present invention.

FIGS. 2–5 collectively show an exemplary mode of operation of the combined automatic latch and deadbolt assembly according to an embodiment of the present invention. It is understood that variations in the structure of the present combined automatic latch and deadbolt assembly may require corresponding changes in the mode of operation thereof, as those of skill in this art may appreciate. It is also to be understood that a resilient member such as a spring (not shown) constantly pushes the latch 102 to the left in this illustration. Turning now to FIG. 2, the combined automatic latch and deadbolt assembly is shown in a configuration in which the first end of the latch 102 is extended, meaning that the first end of the latch 102 extends through the opening in the edge of the door. In this state, the latch has not yet contacted the striker plate which will force it back into the door against its spring (not shown). Moreover, in the configuration of FIG. 2, the first end of the deadbolt 104 is withdrawn, meaning that the first end of the deadbolt 104 does not extend through the opening defined within the latch plate 108. Since the deadbolt 104 may not be extended and will prevent the door from closing if it is extended, the deadbolt 104 here is restrained by the pin 120, which keeps it withdrawn. The configuration shown in FIG. 2 may be called the starting point, and corresponds to what is arbitrarily called zero degrees of rotation. Unlocking the door with the present combined automatic latch and deadbolt assembly is, in this but not all embodiments, a matter of withdrawing and cocking the deadbolt 104 and then withdrawing the latch 102, opening the door, and releasing the latch 102, leading to the state described in FIG. 3 and in which the door to which the present combined automatic latch and deadbolt assembly is coupled is opened, with the latch 102 extended.

Figure 3:
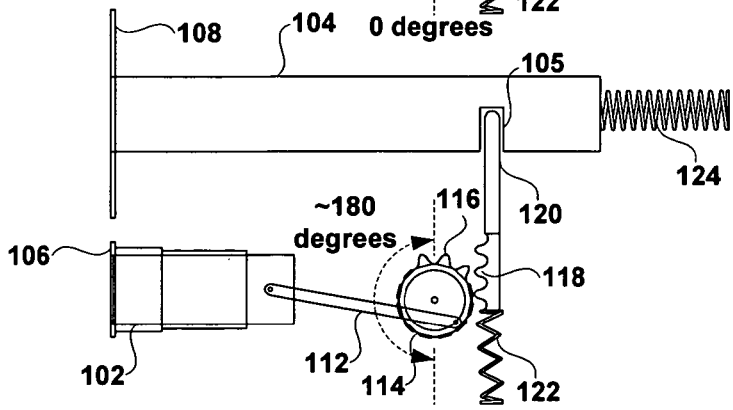
FIG. 3 is a side view of the combined automatic latch and deadbolt assembly in a next configuration in its operation cycle, according to an embodiment of the present invention.

FIG. 3 is a side view of the combined automatic latch and deadbolt assembly in a next state of operation, according to an embodiment of the present invention. In this configuration, the latch 102 is in its retracted configuration, and is pushed in against its spring (not shown) by the latch striker plate 110 (shown in FIG. 1) as the door is closed, for example. As the door closes and the latch 102 is pushed in by the latch striker plate 110, the motion of the latch 102 is transferred to the connecting rod 112 pivotally coupled thereto. As the wheel 114 may be coupled to the connecting rod 112, and may be fixed at its center so as to allow rotation, the wheel 114 may be forced to rotate about its center, in this case in a clockwise direction. According to an embodiment of the present invention, when the latch 102 is fully extended (e.g., at or near the end of its intended range of motion), the wheel 114 may have been caused to rotate about 180 degrees from its initial configuration of FIG. 1. In this state and according to the embodiment of the present invention shown in the drawings, the gear teeth 116 of the wheel 114 have not yet engaged the deadbolt pin gear teeth 118. In both FIGS. 2 and 3, the first resilient member 122 is in its extended configuration, thereby maintaining the deadbolt pin 120 securely engaged within the blind bore 105 defined within the deadbolt 104.

Figure 4:
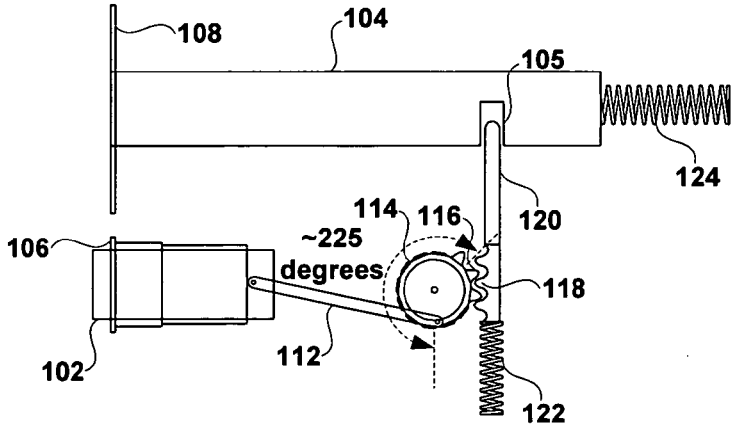
FIG. 4 is a side view of the combined automatic latch and deadbolt assembly in a third configuration, according to an embodiment of the present invention.

As the latch 102 comes up to its extension into the opening defined within the latch striker plate 110 (but is forced fully backward against its spring by the striker plate 110), the embodiment 100 of the present combined automatic latch and deadbolt assembly may come to assume the configuration shown in FIG. 3. In FIG. 3, the contact between the latch 102 in a closing door and the latch striker plate 110 has pushed the latch back 102. The door is not yet fully closed and is neither latched nor deadbolted. A characteristic of embodiments of the present invention is to actuate the deadbolt 104 (cause it to assume its released configuration) just at the instant that the fully extended latch 102 implies that the deadbolt 104 is fully aligned with its socket in the doorpost. FIG. 4 below shows the moment in which the latch 102 begins to fall into its socket, propelled by its spring (present but not shown in the drawings for clarity of illustration). As shown in FIG. 3, according to an embodiment of the present invention, when the latch 102 has traveled about halfway to its fully extended configuration, the connecting rod 112 has been pulled such that the wheel 114 coupled thereto has rotated clockwise about 45 degrees, and the gear teeth 116 thereof are about to engage the corresponding deadbolt pin gear teeth 118. According to an embodiment of the present combined automatic latch and deadbolt assembly 100, the gear teeth 116 of the wheel 114 have not yet engaged with the deadbolt pin gear teeth 118 and have not yet acted upon the deadbolt pin 120. However, as the gear teeth 116 of the wheel continue their clockwise rotation, they may engage the deadbolt pin gear teeth 118. As they do so, they will exert a force on the deadbolt pin 120 that may eventually overcome the biasing force imparted thereon by the first resilient member 122 and begin a motion that will cause the free end thereof to disengage from the blind bore 105 defined within the deadbolt 104 while compressing the first resilient member 122. This configuration is shown in FIG. 4.

As shown in FIG. 4, the wheel 114 may have rotated about 225 degrees from its starting position, as illustrated in FIG. 1. At this state in the operating cycle of the present combined automatic latch and deadbolt assembly, the gear teeth 116 of the wheel 114 have engaged their counterparts deadbolt pin gear teeth 118, beginning to pull the deadbolt pin 120 out of the blind bore 105 defined within the deadbolt 104 which keeps the deadbolt 104 cocked. The motion continues, the latch reaches its full extension, the deadbolt pin 120 is withdrawn from the blind bore 105 into which it was previously engaged, the deadbolt 104 is released, and the second resilient member 124 seats the deadbolt in its socket. The door is now securely locked and deadbolted, with the only action by the householder being to shove the door closed. A significant feature of embodiments of the present invention is the release of the deadbolt 104 automatically just as the falling latch 102 confirms that the door has closed to the point where the deadbolt 104 is completely aligned with its socket. The mechanical logic in this present mechanism insures that the release of the deadbolt happens at an appropriate moment.

Figure 5:
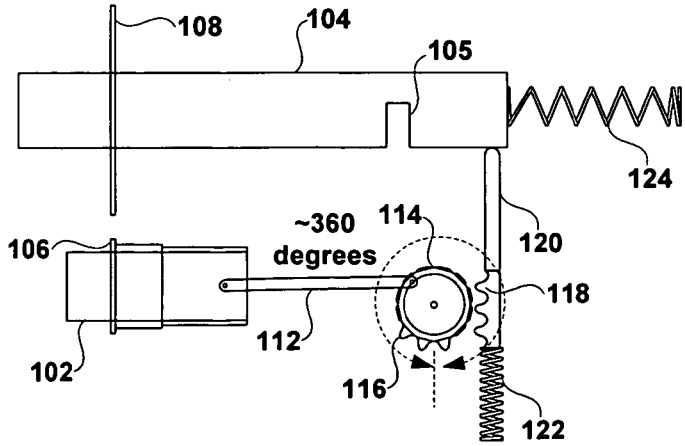
FIG. 5 is a side view of the combined automatic latch and deadbolt assembly in a fourth configuration, according to an embodiment of the present invention.

FIG. 5 is a side view of the combined automatic latch and deadbolt assembly in a fourth configuration, according to an embodiment of the present invention. The combined automatic latch and deadbolt assembly 100 is now in the end state of its operating cycle, with the door fully locked and deadbolted. In this view, the latch 102 is in its fully extended configuration and the deadbolt 104 is in its released configuration. Opening the door, with the unlocking first recocking the deadbolt, return the combined automatic latch and deadbolt assembly 100 the state shown in FIG. 1. As the combined deadbolt and latch assembly 100 assumes the configuration of FIG. 5, the rotation of the wheel 114 eventually causes the deadbolt pin 120 to fully disengage from the blind bore defined within the deadbolt 104. As the second resilient member 124 may, as shown in FIGS. 1–4, be in compression, when the deadbolt pin fully clears the blind bore 105, the deadbolt may be free to travel in a constrained path so as to extend through the deadbolt plate 108, as it is driven by the force imparted thereon by the expanding second resilient member 124. The second resilient member, as shown in FIG. 5 may then be in an expanded configuration. In this configuration, the present embodiment of the combined deadbolt and latch assembly 100 is such that the first ends of both the latch 102 and of the deadbolt 104 have extended through the latch striker plate 110 and the deadbolt plate 108, respectively. When the deadbolt is manually opened (with a key, for example), the deadbolt is pushed back to its starting position, as shown in FIG. 1, in which the deadbolt pin is fully engaged within the blind bore 105. In the configuration shown in FIG. 5, the wheel 114 may have traveled about a full rotation, about 360 degrees.

According to an embodiment, the first and second resilient means 122, 124 may readily be replaced by electromechanical actuators. Such electromechanical actuators may be fed control signals from a controller. In turn, the controller may include a human interface that enables the user to, for example, input a combination (through a keypad, for example) to enable operation of an embodiment of the present combination deadbolt and latch assembly. Those of skill in this art may also recognize that user-input combinations may be replaced with other biometric devices to uniquely identify specific authorized users, and all such variations and embodiments are deemed to fall within the purview of the present inventions.

According to embodiments of the present invention, a single key in a single lock and a turn of the door handle may retract both the latch 102 and the deadbolt 104, as the two may be mechanically coupled, as discussed above. This action allows the deadbolt 104 to be self-locking as the door is closed. Embodiments of the present invention may be configured and set such that one cannot forget to lock the deadbolt 104 of the present combination deadbolt and latch assembly 100, as the deadbolt 104 may be automatically engaged as the door is closed. Although embodiments of the present combined deadbolt and latch assembly readily find utility for residential locks on home doors, embodiments of the present invention may be advantageously deployed in any situation requiring a secure locking of a door. For example, a garage door may be equipped with an embodiment of the present invention, as could any building, container (such as a shipping container) or vehicle having lockable doors.

Advantageously, the present combined deadbolt and latch assembly may be configured to automatically engage the deadbolt 104 when the door (or lid of a container) is closed, thus helping the resident who forgets to throw the deadbolt manually and also the person who has his or her hands full when exiting the door. The extra security more than compensates for the extra cost of the lock, which may be configured so as to require very few additional moving parts than most latch and deadbolt door locks.

What is claimed is:

1. A combined automatic latch and deadbolt assembly, comprising:

a latch;

a deadbolt configured to selectively assume a cocked and a released configuration, the deadbolt defining a deadbolt feature;

a wheel mounted for rotation, the wheel being coupled to the latch and defining a plurality of wheel gear teeth;

a deadbolt pin defining a first and a second end, the deadbolt pin defining deadbolt pin gear teeth near the first end, the second end being configured to selectively engage with and disengage from the deadbolt feature, and the wheel and the deadbolt pin being configured such that movement of the latch causes the wheel to rotate and the wheel gear teeth to engage the deadbolt pin gear teeth so as to selectively a) engage the second end of the deadbolt pin with the deadbolt feature to cause the deadbolt to assume the cocked configuration, and b) disengage the second end of the deadbolt pin from the deadbolt feature to cause the deadbolt to assume the released configuration.

2. The combined automatic latch and deadbolt assembly of claim 1, further comprising a first resilient member that is configured to elastically couple the deadbolt pin to a support.

3. The combined automatic latch and deadbolt assembly of claim 2, wherein the first resilient member includes a first spring.

4. The combined automatic latch and deadbolt assembly of claim 1, further comprising a second resilient member that is configured to elastically couple the deadbolt to a support.

5. The combined automatic latch and deadbolt assembly of claim 1, wherein the second resilient member includes a second spring.

6. The combined automatic latch and deadbolt assembly of claim 1, wherein the deadbolt feature includes a blind bore defined within the deadbolt, the blind bore being configured to receive the second end of the deadbolt pin.

7. The combined automatic latch and deadbolt assembly of claim 1, wherein two rotations of the wheel returns the combined automatic latch and deadbolt assembly to a same state of operation.

8. The combined automatic latch and deadbolt assembly of claim 1, further comprising a connecting rod coupled to the latch and to the wheel.

9. The combined automatic latch and deadbolt assembly of claim 1, wherein the connecting rod is coupled near a circumference of the wheel.

10. A combined automatic latch and deadbolt assembly comprising:

a latch configured to selectively assume a retracted and extended configuration;

a deadbolt that includes a deadbolt feature and that is configured to selectively assume a cocked and a released configuration, and a mechanical coupling configured to couple the latch to the deadbolt, the mechanical coupling including a deadbolt pin that includes a first and a second end, the deadbolt pin defining deadbolt pin gear teeth near the first end, the second end being configured to selectively engage the deadbolt feature when the deadbolt is in its cocked configuration and to disengage from the deadbolt feature to cause the deadbolt to transition from its cocked configuration to its released configuration when the latch transitions from its retracted configuration to its extended configuration.

11. The combined automatic latch and deadbolt assembly of claim 10, wherein the latch and the deadbolt are spring loaded.

12. The combined automatic latch and deadbolt assembly of claim 10, further including a wheel mounted for rotation, the wheel being coupled to the latch and defining a plurality of wheel gear teeth, the wheel and the deadbolt pin being further configured such that movement of the latch causes the wheel to rotate and the wheel gear teeth to engage the deadbolt pin gear teeth so as to selectively a) engage the second end of the deadbolt pin with the deadbolt feature to cause the deadbolt to assume the cocked configuration, and b) disengage the second end of the deadbolt pin from the deadbolt feature to cause the deadbolt to assume the released configuration.

13. The combined automatic latch and deadbolt assembly of claim 10, further comprising a first resilient member that is configured to elastically couple the deadbolt pin to a support.

14. The combined automatic latch and deadbolt assembly of claim 13, wherein the first resilient member includes a first spring.

15. The combined automatic latch and deadbolt assembly of claim 10, further comprising a second resilient member that is configured to elastically couple the deadbolt to a support.

16. The combined automatic latch and deadbolt assembly of claim 15, wherein the second resilient member includes a second spring.

17. The combined automatic latch and deadbolt assembly of claim 10, wherein the deadbolt feature includes a blind bore defined within the deadbolt, the blind bore being configured to receive the deadbolt pin.

18. The combined automatic latch and deadbolt assembly of claim 12, wherein two rotations of the wheel returns the combined automatic latch and deadbolt assembly to a same state of operation.

19. The combined automatic latch and deadbolt assembly of claim 12, further comprising a connecting rod coupled to the latch and to the wheel.

20. The combined automatic latch and deadbolt assembly of claim 19, wherein the connecting rod is coupled near a circumference of the wheel.

* * * * *